US008894164B2

(12) United States Patent
Zimmer et al.

(10) Patent No.: US 8,894,164 B2
(45) Date of Patent: Nov. 25, 2014

(54) GUIDE ARRANGEMENT WITH COMBINED DECELERATION AND ACCELERATION ARRANGEMENT

(76) Inventors: Günther Zimmer, Rheinau (DE); Martin Zimmer, Rheinau (DE)

( * ) Notice: Subject to any disclaimer, the term of this patent is extended or adjusted under 35 U.S.C. 154(b) by 62 days.

(21) Appl. No.: 13/478,183

(22) Filed: May 23, 2012

(65) Prior Publication Data

US 2012/0269470 A1 Oct. 25, 2012

Related U.S. Application Data

(63) Continuation-in-part of application No. PCT/DE2010/001359, filed on Nov. 24, 2010.

(30) Foreign Application Priority Data

Nov. 24, 2009 (DE) ..... 10 2009 054 331

(51) Int. Cl.

| | |
|---|---|
| ***A47B 95/00*** | (2006.01) |
| ***A47B 88/04*** | (2006.01) |
| ***E05F 1/16*** | (2006.01) |
| ***E05F 5/00*** | (2006.01) |

(52) U.S. Cl.

CPC ..... *A47B 88/047* (2013.01); *E05F 1/16* (2013.01); *E05F 5/003* (2013.01); *E05Y 2600/53* (2013.01); *E05Y 2900/20* (2013.01)

USPC ..... 312/333; 312/334.1

(58) Field of Classification Search

USPC ..... 312/333, 334.1, 334.7, 334.8, 334.6

See application file for complete search history.

(56) References Cited

U.S. PATENT DOCUMENTS

| | | | | |
|---|---|---|---|---|
| 6,629,738 | B2 * | 10/2003 | Salice | 312/333 |
| 6,953,233 | B2 * | 10/2005 | Lam et al. | 312/333 |
| 7,472,973 | B2 * | 1/2009 | Huang | 312/333 |
| 7,600,828 | B2 * | 10/2009 | Chen et al. | 312/333 |
| 7,854,485 | B2 * | 12/2010 | Berger | 312/333 |
| 7,980,640 | B2 * | 7/2011 | Yang | 312/333 |
| 2003/0234604 | A1 | 12/2003 | Lin | |
| 2009/0273129 | A1 * | 11/2009 | Zimmer et al. | 267/170 |
| 2011/0043087 | A1 * | 2/2011 | Shih et al. | 312/334.1 |
| 2013/0076218 | A1 * | 3/2013 | Radusin | 312/319.1 |

* cited by examiner

*Primary Examiner* — Daniel Rohrhoff

(74) *Attorney, Agent, or Firm* — Klaus J. Bach

(57) ABSTRACT

In a guide arrangement with a combined deceleration and acceleration arrangement which is disposed in a carrier housing mounted on a guide track, the carrier housing includes at least two spaced engagement elements and the guide track includes corresponding counter engagement elements which, together form clamping connections wherein at least one of the carrier housing-side and the guide track-side engagement elements or in the form of projections and the corresponding engagement elements guide track or, respectively, the housing-side engagement are in the form engagement ears slidably receiving the projections.

6 Claims, 3 Drawing Sheets

GUIDE ARRANGEMENT WITH COMBINED DECELERATION AND ACCELERATION ARRANGEMENT

This is a continuation-in-part application of pending international patent application PCT/DE 2010/001359 filed Nov. 24, 2010 and claiming the priority of German patent application 10 2009 054 331.7 filed Nov. 24, 2009

BACKGROUND OF THE INVENTION

The invention resides in a guide arrangement with a combined deceleration and acceleration arrangement disposed in a carrier housing.

DE 10 2006 058 639 A1 discloses a combined deceleration and acceleration arrangement. This arrangement is screwed onto a guide structure before assembly of a furniture piece and is then installed in the furniture piece. With a later assembly, the guide arrangement first needs to be uninstalled.

It is therefore the object of the present invention to provide a guide arrangement which can be easily installed without problems.

SUMMARY OF THE INVENTION

In a guide arrangement with a combined deceleration and acceleration arrangement which is disposed in a carrier housing mounted on a guide track, the carrier housing includes at least two spaced engagement elements and the guide track includes corresponding counter engagement elements which, together, form clamping connections wherein at least one of the carrier housing-side and the guide track-side engagement elements are in the form of projections and the corresponding engagement elements, that is the guide track or, respectively, the housing-side engagement elements are in the form of an engagement ears slidably receiving the projections.

The invention will become more readily apparent from the following description of a particular embodiment thereof described below with reference to the accompanying drawings.

DETAILED DESCRIPTION OF THE INVENTION

Figure 1:
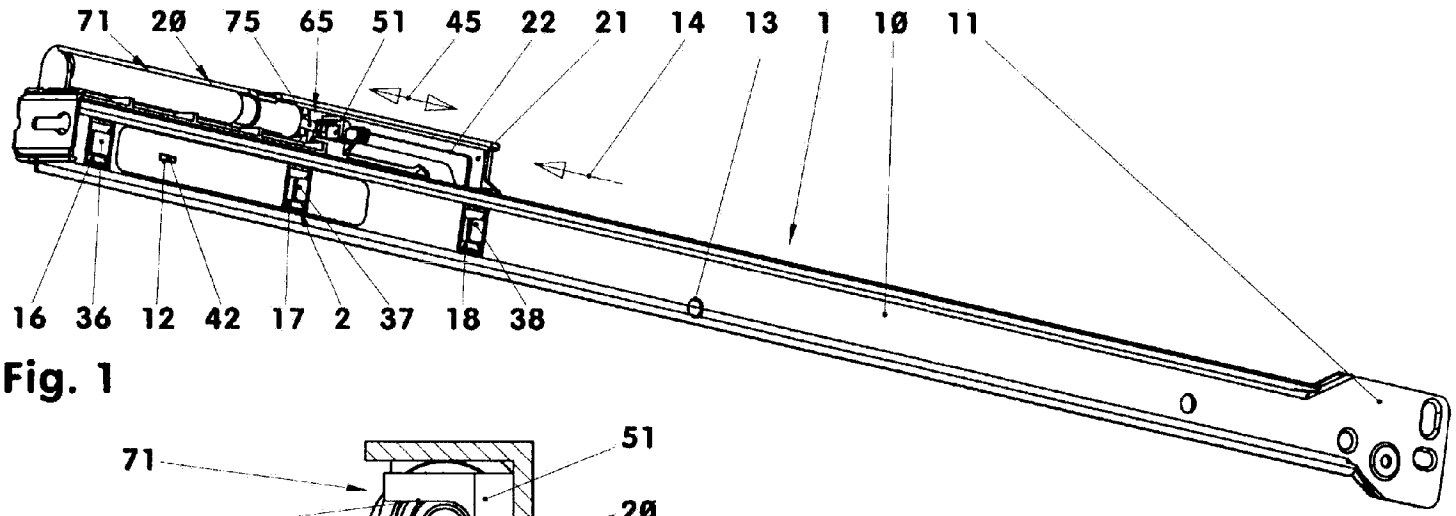
FIG. 1 is a perspective view of a guide arrangement.
Figure 2:
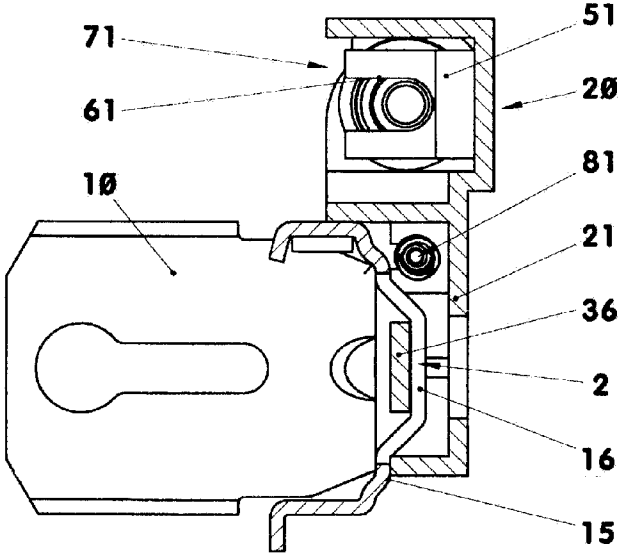
FIG. 2 is a cross-sectional view of the guide arrangement.

FIGS. 1 and 2 show a guide arrangement 1 with a guide track 10 and a combined deceleration and acceleration arrangement 20 disposed in a support housing mounted to the guide track. Such guide arrangements 1 are used in connection for example with pull-outs, drawers, etc. By means of such guide arrangement 1, the pull-out is slowed down when moved in or pulled out in an end stroke range into the closed or open end position.

Figure 3:
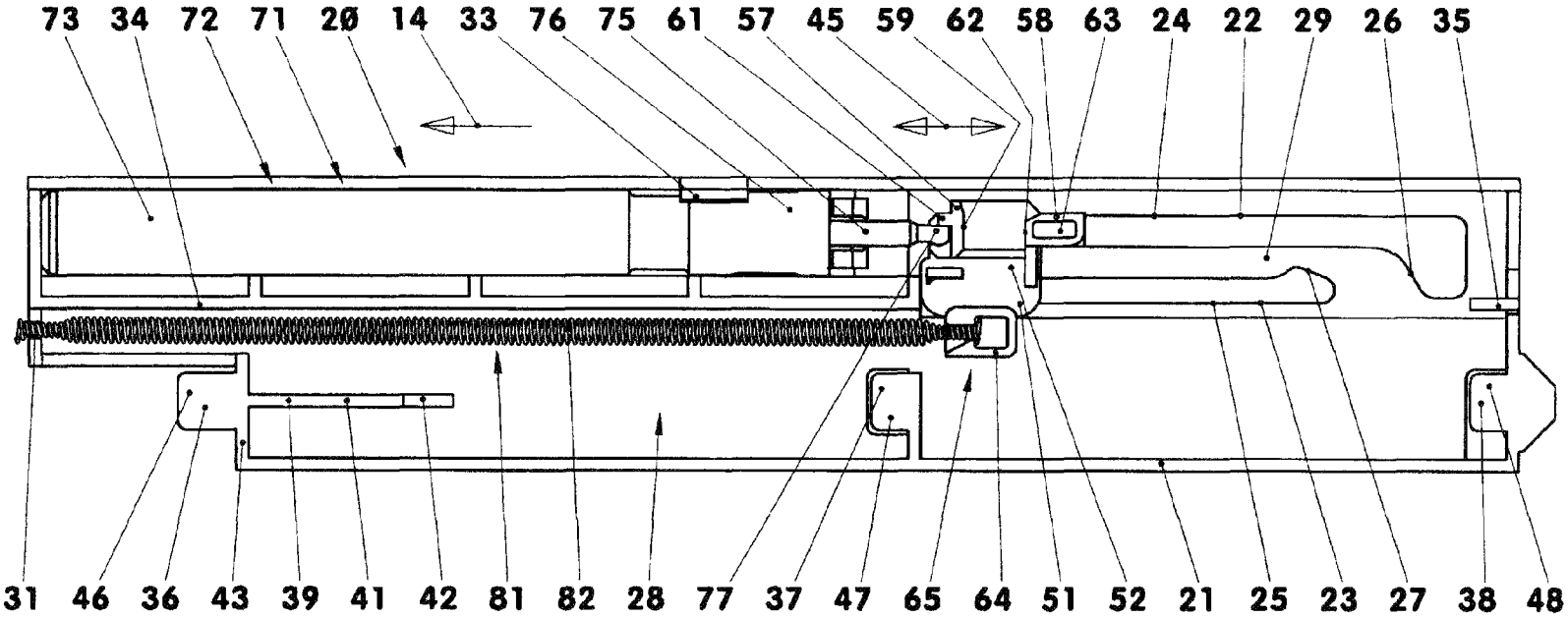
FIG. 3 shows a deceleration and acceleration arrangement mounted on a guide track.
Figure 4:
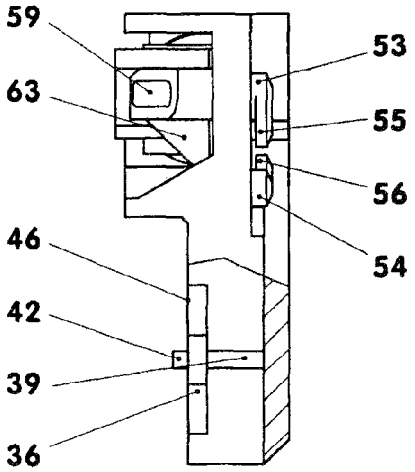
FIG. 4 shows the deceleration and acceleration arrangement as shown in FIG. 3 in a cross-sectional view.

The combined deceleration and acceleration arrangement (20) is shown in FIGS. 3 and 4. It comprises a carrier housing 21 in which a pneumatic cylinder piston unit 72 is arranged. This cylinder-piston unit 72 which consists for example of a plastic material includes a cylinder 73 in which a piston provided with a piston rod 75 is movably supported. The piston rod 75 which projects from the cylinder head end 76 is for example elastically deformable. In the embodiment shown, the piston rod head 77 is for example in the form of a ball head which is pivotally received in a cap-shaped cavity 61 of a carrier element 51.

The carrier element consists for example of aluminum. It has a disc-like base body 52, which is guided by means of to two guide pins 53, 54 in two guide grooves 22, 23 of the carrier housing 21 which are spaced from each other. The guide grooves (22, 23) which extend in certain areas parallel to each other have different lengths. The length of the longer guide groove 22 which faces away from the mounting area 28 of the carrier housing 21 is in the shown exemplary embodiment 130% of the length of the shorter guide groove 23. Both guide grooves 22, 23 comprise straight sections 24, 25 which extend parallel to each other and cavities 26, 27 which face away from the cylinder piston unit 72. The shorter guide groove 23 is displaced with respect to the longer guide groove 22 by 10% in the direction of the cylinder-piston unit 72. The distance of the straight sections 24, 25 is for example 16% of the length of the stroke of the shorter guide groove 23. The cavity 26 of the longer guide groove 22 may merge to the straight section via an obtuse angle or a circular sectional transition area. The guide pins 53, 54 have engagement elements 55, 56', which extend behind the guide web 29 arranged between the guide grooves 22, 23.

At its side facing away from the guide pins 53, 54, the base body 52 has for example two engagement projections 57, 58. The engagement projection 57 facing the cylinder-piston unit 72 has an engagement surface 59 and the piston rod head has a piston rod head receiving area 61. The second engagement projection 58 includes an abutment surface 62 and a lead-in area 63, which extend at an acute angle with respect to the base body 52 and the engagement surface 59.

Furthermore, the carrier element 51 includes a spring accommodation area 64, in which the spring 82 is supported with one end thereof while the other end of the spring 82 is received in a spring reception 31 of the carrier housing 21. The spring 82 is for example a tension spring 82, which is part of the acceleration arrangement 81.

The carrier housing 21 is U-shaped in both, the longitudinal and the transverse cross-section. In the exemplary embodiment, it has a length of 180 millimeter, a width of 40 millimeter and a depth of 15 millimeter. As a result, the length of the carrier housing 21 and, consequently, the length of the combined deceleration and acceleration arrangement 20 is shorter than four times the piston stroke of the cylinder-piston unit 72. The cylinder-piston unit 72 is supported for example by means of a central accommodation pin and an elastically deformable engagement clamp 33. In addition, the carrier housing 21 includes two support webs 34, 35, which are oriented in the longitudinal direction of the carrier housing.

In FIGS. 3 and 4, below the acceleration arrangement 81, three form engagement elements 36, 37, 38, such as engagement projections or pins, are arranged within, for example, a rectangular cavity of the carrier housing 21. All of the engagement projections 36, 37, 38 point in the same direction 14 and have the same width. The engagement element or projection 36, which is shown in FIG. 3 at the left and which projects from an end wall 43 of the carrier housing 21 and is clamped thereto, is for example 50% longer than the center engagement projection 37 and the right engagement projection 38. The engagement projection 36 has for example a length of seven millimeters. However, the lengths of the engagement projections 36, 37, 38 may also decrease from the left to the right in the representation of FIG. 3. The distance between the longest engagement projection 36 and the center engagement projection 37 is for example 15% greater than the distance between the center projection 37 and the right engagement projection 38.

Adjacent the longest engagement projection 36, there is a support web 39 which is for example in the same plane as the slide surfaces 46, 47, 48 of the engagement projections 36, 37, 38 facing the viewer. The support web 39 further has an engagement knob which extends normal to the support surface 41. Its length is about 20% of the length of the support web 39.

Figure 6:
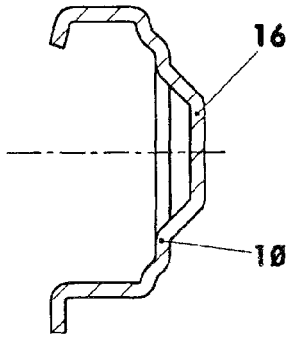
FIG. 6 is a cross-sectional view of the guide track.
Figure 5:
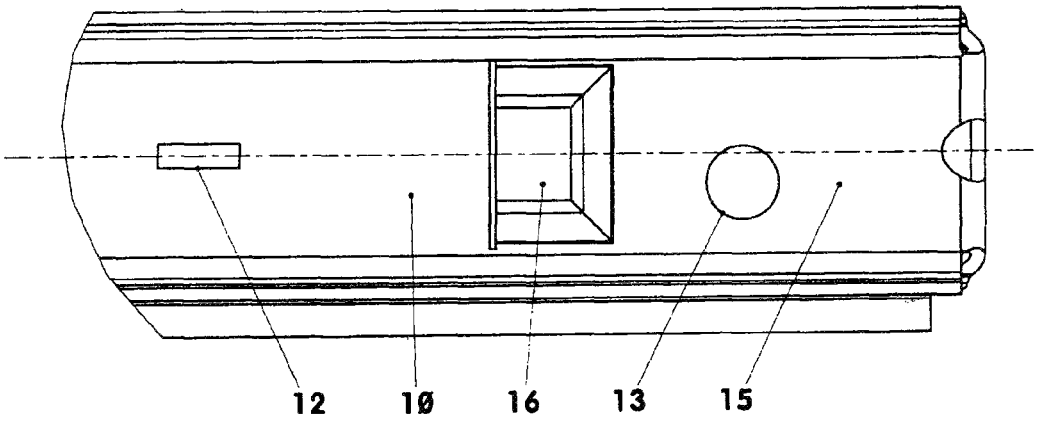
FIG. 5 is a partial view of the guide track.

The guide track 10, see FIGS. 1 and 5, consists of an at least approximately U-shaped metal sheet of a length of 590 millimeters and a width of 25 millimeters. In the flat area 11, the width is for example 36 millimeters. The guide track 10 has openings 13 for mounting it, a cut-out 12 in the form of a longitudinal groove and three form-locking engagement elements 16-18 such as knobs 16-18. The knobs 16-18 have for example the same shape and project outwardly by the thickness of a metal sheet in a direction opposite to the edges of the track 10, see FIG. 6. The distance between the left knob 16 and the center knob 17 is for example larger, by 12%, than the distance between the center knob 17 and the right knob 18. The opening width of the individual knob 16-18 is for example wider by 5% than the width of an engagement projection 36-38. The length of a knob 16-18 is shorter, by 10%, than this amount. The distance of the knobs 16-18 from one another corresponds to the distance of the engagement areas of the engagement projections 36-38 from one another.

For mounting, first for example the carrier element 51 is inserted into the support housing 21. Subsequently, the spring 82 and the cylinder-piston unit 72 are installed in the housing 21 and connected to the carrier element 51.

Then the combined deceleration and acceleration arrangement 20 can be attached to the guide track 10 which, depending on circumstances, has already been mounted to a furniture body part or to a drawer. To this end, the combined deceleration and acceleration arrangement 20 is so placed onto the guide track 10 that the longest engagement projection 36 extends below the knob 16. The two engagement elements 16, 36 form a clamp connection 2. Herein, the support surface 41 abuts a mounting surface 15 of the guide track 10. Also, the slide surfaces 47, 48 are disposed for example on the mounting surface 15. Upon further insertion of the combined deceleration and acceleration arrangement 20 in the mounting direction 14 for example after a stroke of 3 millimeter, also the engagement projections 37, 38 are moved behind the knobs 17, 18 of the guide track 10 to form further clamping connections 2. The mounting stroke is then continued until the engagement projection 42 snaps into the longitudinal cut-out 12. The mounting direction 14 is in the shown example parallel to the main working direction 45 of the combined deceleration and acceleration arrangement 20.

The guide arrangement 1 assembled in this way is for example installed on a drawer. The drawer has for example a carrier pin. With the first insertion of the drawer, the pin slides for example along the lead-in area 63 and moves between the receiving pins 57, 58.

When now the drawer is pulled out, the carrier pin pulls the carrier element 51 from the end position 65 shown in the FIGS. 1 and 3 into a park position. Hereby, the piston rod is extended and the spring 82 is tensioned. As soon as the guide pin 54 has reached its end position, the carrier element 51 is pivoted. When the drawer is now pulled out further, the carrier pin is released. The combined deceleration and acceleration arrangement 20 remains in the park position.

Upon re-insertion of the drawer, the carrier pin engages, in a partial stroke near the closed end position of the drawer, the combined acceleration and deceleration arrangement 20, whereby the carrier element 51 is released from the park position. The piston rod 75 is pulled back into the cylinder. The air displaced from the cylinder chamber causes a deceleration of the drawer. The deceleration force is superimposed by the acceleration force of the acceleration arrangement 81. The spring 82 is relaxed and pulls the drawer slowly into the closed end position.

For uninstalling the combined deceleration and acceleration arrangement 20, the carrier housing 21 can be grasped at the center thereof so that the engagement projection 42 is released from the longitudinal slot 12. Then the combined deceleration and acceleration arrangement 20 can be moved out of the guide track 10 by sliding it in a direction opposite to the installation direction 14.

It is also possible that the carrier-side engagement elements 36-35 are in the form of ears and the guide-track-side engagement elements 16-18 are in the form of spigots.

Also, a design of a deceleration and acceleration arrangement 71, 81 other than the one described may be used.

Listing of Reference Numerals

| | |
|---|---|
| 1 | Guide arrangement |
| 2 | Clamping connection |
| 10 | Guide track |
| 11 | Flat end area |
| 12 | Cut-out |
| 13 | Opening |
| 14 | Direction |
| 15 | Mounting surface |
| 16 | Engagement ear |
| 17 | Engagement ear |
| 18 | Engagement ear |
| 20 | Combined deceleration and acceleration arrangement |
| 21 | Carrier housing |
| 22 | Guide groove |
| 23 | Guide groove |
| 24 | Straight section |
| 25 | Straight section |
| 26 | Cavity |
| 27 | Cavity |
| 28 | Mounting area |
| 29 | Guide web |
| 31 | Spring reception |
| 33 | Engagement clamp |
| 34 | Support web |
| 35 | Support web |
| 36 | Engagement element, projection |
| 37 | Engagement element, projection |
| 38 | Engagement element, projection |
| 39 | Support web |
| 41 | Support surface |
| 42 | Engagement projection |
| 43 | End wall |
| 45 | Main working direction |
| 46 | Slide surface |
| 47 | Slide surface |
| 48 | Slide surface |
| 51 | Carrier element |
| 52 | Base body |
| 53 | Guide pin |
| 54 | Guide pin |
| 55 | Engagement element |
| 56 | Engagement element |
| 57 | Projection |
| 58 | Projection |
| 59 | Engagement surface |
| 61 | Piston rod head receiving area |
| 62 | Abutment surface |
| 63 | Lead in area |
| 64 | Spring accommodation area |
| 65 | End position |

-continued

| Listing of Reference Numerals | |
|---|---|
| 71 | Deceleration arrangement |
| 72 | Piston cylinder unit |
| 73 | Cylinder |
| 75 | Piston rod |
| 76 | Cylinder head end |
| 77 | Piston rod head |
| 81 | Acceleration arrangement |
| 82 | Spring |

What is claimed is:

1. A guide arrangement (1) including a combined deceleration and acceleration arrangement (20) disposed in a carrier, housing (21) mounted on a guide track:

the carrier housing (21) including at least two spaced housing-side engagement elements (36, 37; 37, 38; 36, 38), the guide track (10) including at least two corresponding guide track-side engagement elements (16, 17; 17, 18; 16, 18) which form, together with the respective carrier housing-side engagement elements (36, 37; 37, 38; 36, 38), a clamping connection (2) and at least one of the carrier housing-side engagement elements (36, 37; 37, 38; 36, 38) and the guide track-side engagement elements (16, 17; 17, 18; 16, 18) being in the form of cantilevered engagement projections and the respective other engagement elements (16, 17; 17, 18; 16, 18; 36, 37; 37, 38; 36, 38) being in the form of ears, the cantilevered engagement projections extending all in the same direction and the cantilevered engagement projection (36) first inserted below an engagement ear (16) during installation of the deceleration and acceleration arrangement (20) being longer than the other cantilevered engagement projections (37, 38), a support web (39) being arranged on the housing (21) adjacent the first inserted cantilevered engagement projection (36) so as to form a support surface (41) disposed in a plane along which the other engagement projections (37, 38) are arranged, and the support web (39) being provided with another engagement projection (42) extending normal to the support surface (41) and being received in a cut-out (12) of the guide track (10).

2. The guide arrangement according to claim 1, wherein the direction (14) of orientation is parallel to the main operating direction (45) of the combined deceleration and acceleration arrangement (20).

3. The guide arrangement according to claim 1, wherein the engagement projections (36-38) are arranged on the carrier housing (21).

4. The guide arrangement according to claim 1, wherein the longest engagement projection (36) is disposed, adjacent a limiting wall (43) of the carrier housing (21).

5. The guide arrangement according to claim 1, wherein the guide track (10) includes at least three engagement ears (16-18) whose distance from each other corresponds to the distance between the respective engagement projections (36-38).

6. The guide arrangement according to claim 1, wherein the opening width of the individual engagement ears (16 -18) is wider by 5% than the width of an engagement projections (36-38).

* * * * *